United States Patent [19]

Burmeister et al.

[11] Patent Number: 4,570,518

[45] Date of Patent: Feb. 18, 1986

[54] POSITIONING APPARATUS FOR TREATMENT DEVICE

[75] Inventors: Harland A. Burmeister, Outagamie County; Lee A. Weinig, Winnebago County, both of Wis.

[73] Assignee: Kimberly-Clark Corporation, Neenah, Wis.

[21] Appl. No.: 618,967

[22] Filed: Jun. 11, 1984

[51] Int. Cl.[4] ..... B26D 1/22

[52] U.S. Cl. ..... 83/504; 83/505; 83/508.3; 83/700

[58] Field of Search ..... 83/498, 499, 504, 508.2, 83/508.3, 505, 506, 425.2, 425.4, 700; 493/56, 60, 228–230, 241, 355, 363; 242/56.2–56.7; 403/43–49; 74/586

[56] References Cited

U.S. PATENT DOCUMENTS

| | | | |
|---|---|---|---|
| 2,613,571 | 10/1952 | Merman | 83/664 X |
| 3,376,774 | 4/1968 | Collins et al. | 83/482 |
| 3,411,392 | 11/1968 | Spangler | 83/498 X |
| 3,583,270 | 6/1971 | Webb | 83/433 |
| 3,886,833 | 6/1975 | Gunn et al. | 83/499 |
| 3,944,150 | 3/1976 | Jennerjahn | 242/56.2 |
| 4,033,393 | 7/1977 | Bedi | 411/301 |
| 4,077,291 | 3/1978 | Obershain | 83/499 |
| 4,398,678 | 8/1983 | Kron et al. | 242/56.3 |

FOREIGN PATENT DOCUMENTS

| | | | |
|---|---|---|---|
| 712861 | 7/1965 | Canada . | |
| 814210 | 6/1969 | Canada | 411/301 |
| 852551 | 9/1970 | Canada . | |
| 884138 | 10/1971 | Canada . | |
| 668233 | 3/1952 | United Kingdom . | |

*Primary Examiner*—James M. Meister

*Attorney, Agent, or Firm*—P. A. Leipold; J. P. O'Shaughnessy; J. J. Duggan

[57] ABSTRACT

The invention relates to an apparatus for slitting of continuous webs into ribbons. The apparatus is composed of a series of cutters, preferably of the crush-cutter type that are slidably mounted on a support such as rail or series of rails. The cutters are each provided with a mounting bracket. The mounting bracket on each cutter is adapted to receive two individual adjustment devices. The adjustment devices are provided to individually and rigidly connect each adjacent cutter. In the preferred system, the individual adjustment devices are threaded studs with a center adjustment nut that is turned to bring the cutters closer or provide greater distance between them. Adjustment of any single stud leads to movement of the whole series of cutters as the individual devices between the other cutters will maintain their distance between adjacent cutters, and the cutters will slide upon the mounting rails.

12 Claims, 6 Drawing Figures

POSITIONING APPARATUS FOR TREATMENT DEVICE

TECHNICAL FIELD

This invention relates to adjustment of treatment devices such as slitters for traveling webs. It particularly relates to adjustment means for the adjustment of the spacing between the cutters that are used in the slitter for cutting a web of material into a multiplicity of ribbons.

BACKGROUND

It has been the practice in the cutting of webs of paper and plastic to provide a group of cutters across the path of the webs to accomplish the cutting of the wide web into a series of ribbons. It has been the normal practice to provide simple manual adjustment in the clamping of the cutters and their supports whenever it is necessary that adjustment of the cutters be made. It is desirable to minimize the time needed for adjustment of the cutters when making major adjustments. Further, it is desirable that the fine adjustments of the cutters may be performed while the machine is operating without down-time or loss of production material.

There have been proposed systems for adjustment of the cutter that form the slitter systems for paper handling. The systems suggested such as those in U.S. Pat. No. 3,583,270—Web, Canadian Pat. No. 712,861—Patterson, and Canadian No. 884,138—Osborn, et al. to provide threaded rods upon which the cutters of the slitter system are moved. It also is proposed that the location of cutters on such rods be electrically controlled. However, such systems having automatic control and means to clamp and unclamp the slitters to the adjusting screw are complicated and expensive.

In the cutting of coform material which is a air-formed mixture of wood fibers and meltblown polypropylene, there has been a need for a cutter system that is rapidly adjustable, very accurate, and low in cost. In the formation of coform, the speeds of formation are not extremely high, such as in paper forming and treatment, and the production levels cannot justify at this time the extremely expensive computer-controlled slitter equipment. There has remained a need for a easily-adjustable cutter system that has extreme accuracy and dependability. There further is a need for a cutter system that is easily adjustable, both for major adjustments and for minor adjustments between adjacent cutters while the machine is operating.

DISCLOSURE OF THE INVENTION

The invention relates to an apparatus for treatment of sheet materials, such as the slitting of continuous webs into ribbons. The apparatus provides a means of adjustment between treatment devices. In a preferred embodiment, the apparatus is composed of a series of cutters, preferably of the crush cutter-type that are slidably mounted on a support such as rail or series of rails. The cutters are each provided with a mounting bracket. The mounting bracket on each cutter is adapted to receive two individual adjustment devices. The adjustment devices are provided to individually and rigidly connect each adjacent cutter. Each of the adjustment devices may be individually adjusted. In the preferred system, the individual adjustment devices are threaded studs with a center adjustment nut that is turned to bring the cutters closer or provide greater distance between them. Adjustment of any single stud leads to movement of the whole series of cutters as the individual devices between the other cutters will maintain their distance between adjacent cutters, and the cutters will slide upon the mounting rails.

DETAILED DESCRIPTION OF THE INVENTION

The apparatus and method of the invention provides a fast, convenient, low-cost and accurate system for adjusting a group of cutters in a slitter. The instant system is particularly advantageous in that the distance between any two cutters of a series may be adjusted while the distance between all other cutters remains exactly as it was before the adjustment. In the typical adjustment system when one cutter is adjusted it is likely that all other cutters must necessarily be readjusted as the first adjustment will change the setting of the distance between the adjacent cutters. The slitter system further is advantageous in that it does not require precise screw drives or the precision system for releasing and fixing cutters on to the bar. These and other advantages of the invention will be apparent from the description below.

Figure 1:
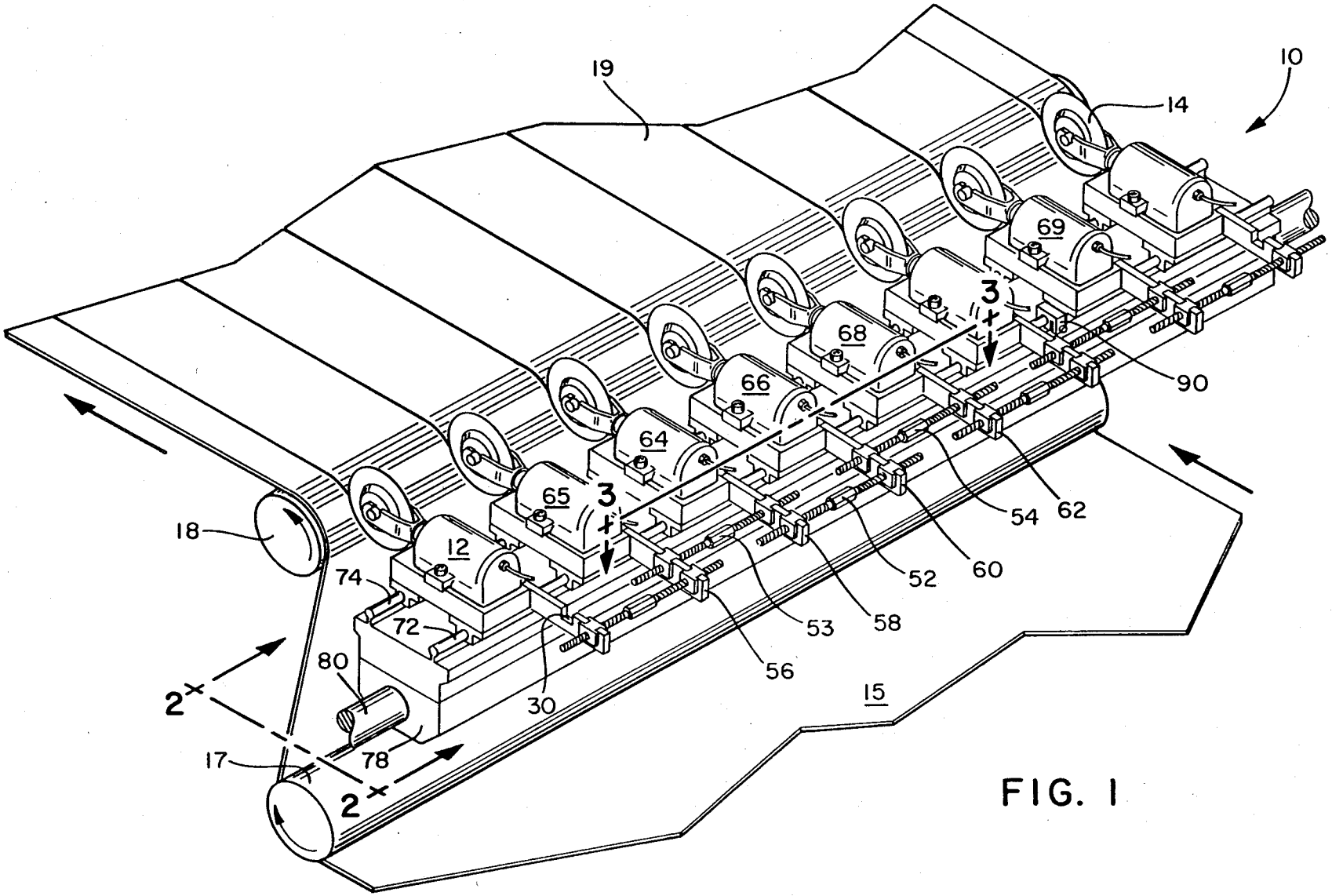
FIG. 1 is a perspective view of a series of slitters in accordance with the invention.

In FIG. 1 there is illustrated a slitter assembly 10 in accordance with the invention. The slitter assembly is made up of individual cutters 12. The cutters as illustrated are crush cutters, although the adjustment system of the invention is suitable for use with other cutters. The cutters are arranged to cut web material 15 into individual ribbons such as 19.

Figure 2:
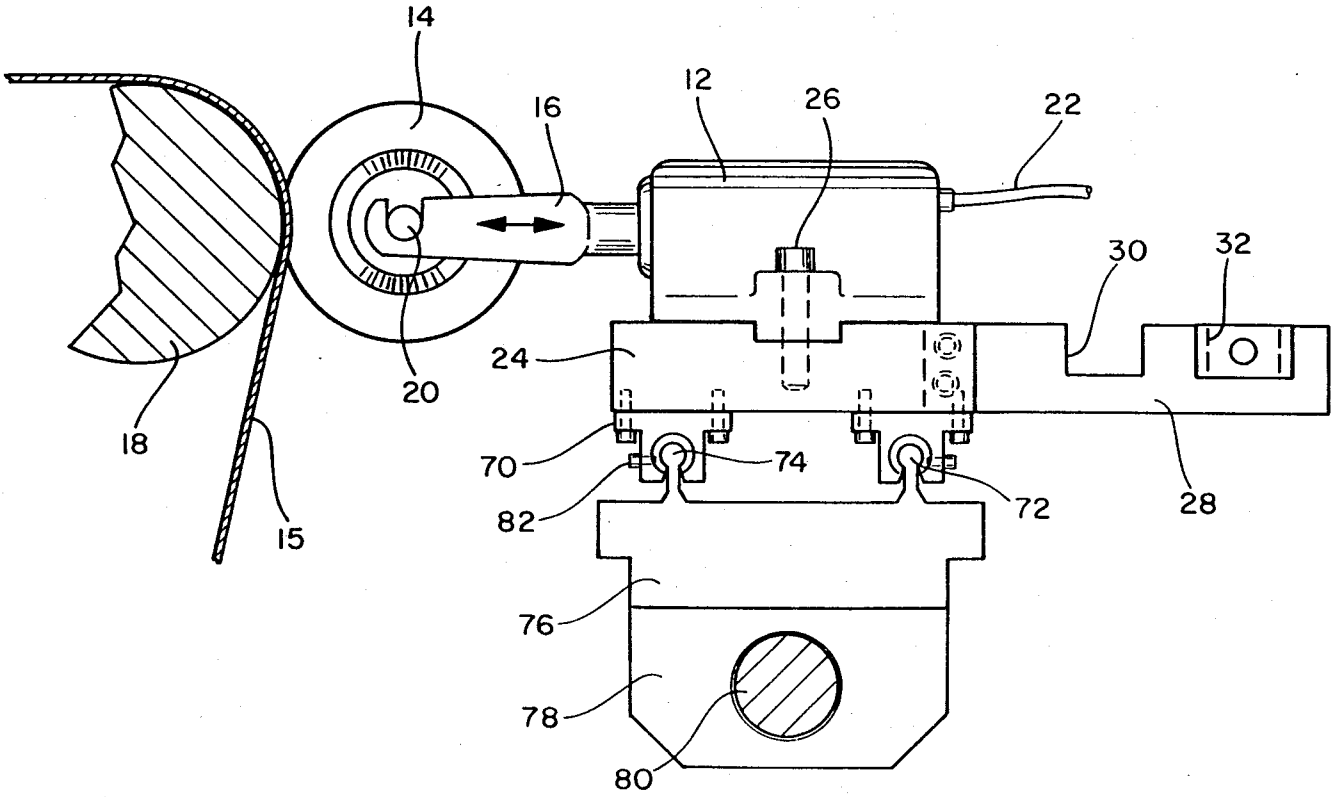
FIG. 2 is a view of a cutter of the invention.
Figure 4:
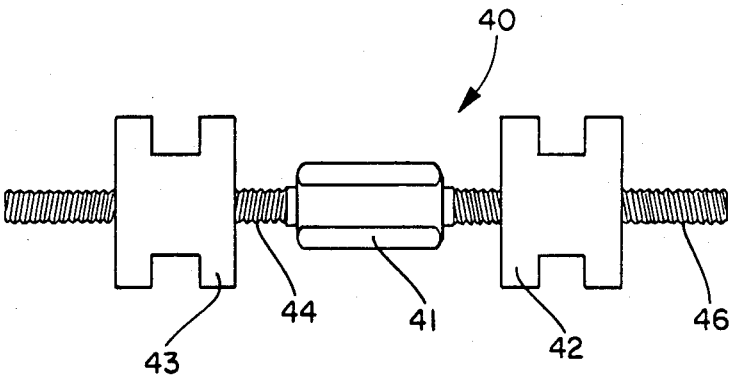
FIG. 4 is a view of the stud and nuts utilized in the adjustment system of the invention.

As illustrated in FIGS. 1 and 2, the movable arm 16 and cutting blade 14 are pneumatically operated to press cutting blade 14 against the material 15 that is passing between it and the backing roll 18. The cutter 14 is not driven but moves by frictional force causing rotation on bearing 20. The arm is actuated by pneumatic pressure through pneumatic inlet 22 from a source of pneumatic force (not shown). Each cutter 12 is mounted rigidly to a base plate 24 by bolts such as 26. Each base plate 24 carries a mounting plate 28 having two notches numbered 30 and 32 in FIG. 2. Into these slots are placed adjusting stud assemblies 40 such as illustrated in FIG. 4. The studs 41 have screwed onto them nuts 42 and 43. The nuts 42 have a "H" shaped cross-section that fits into the slots 30 and 32 of mounting plate 28. The stud 41 has a screw portion 44 and 46. The screw threads of the stud 41 are opposing such that when the stud 41 is turned, the nuts 42 and 43 will be either drawn together or spaced further apart.

Figure 3:
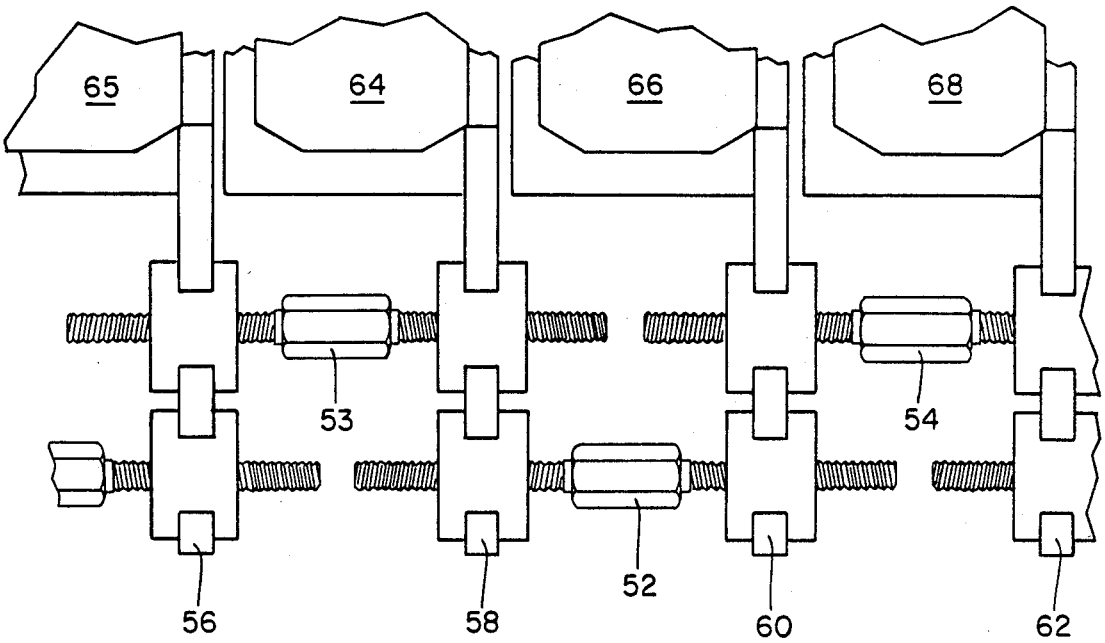
FIG. 3 is a view of the adjustment system of the invention illustrated with four cutters.

As illustrated in FIG. 3, the arrangement of the stud assemblies 52, 53, and 54, are placed between the mounting plates 56, 58, 60, and 62 of the four cutters 64, 65, 66, and 68. It will be apparent that turning of the stud assembly 52 will adjust the distance between the cutters 64 and 66, but will not affect the cut between cutter 64 and 65, and further will not affect the distance between the cuts of cutter 66 and 68. Further, any cutters that are attached in sequence to 65 and 68 using the invention also will maintain their set distances.

It is important in the instant invention that the cutters ride in a rigid bearing system that does not allow significant flexing on the bearings or, of course, in the arm 16 of the cutter. The mounting system as shown in FIGS. 1 and 2 is comprised of a rigid plate 24 to which the cutter 12 is bolted. The plate 24 is rigidly attached such as by bolts to bearings 70. The bearings ride on a rigid rail structure of parallel rails 72 and 74. These rails are integrally attached to or form a part of the rail foundation 76. The rail foundation 76 is rigidly attached by welding or bolting to mounting plate 78 that is borne on the support 80. The cutters may pivot on support 80 when they are withdrawn for servicing of the machine. The preferred type of bearing is a Ball Bushing such as that sold by Thompson Industries, Inc. The Ball Bushing type bearing is suitable for linear motion as the balls in the bearings are arranged for longitudinal motion along the rail or rod with recirculating of the balls in the bearing to allow linear motion without looseness. The ball bearing bushing is adjustable by bolt 82 to remove any play. The bearings should allow movement of the cutter 12 along the rails 72 and 74, but not allow play.

The studs 40 may be formed of any suitable material. Generally they are formed of steel and most preferably stainless steel for its corrosion resistant properties.

The nuts 42 and 43 may be formed of any suitable material. Typical of such materials are stainless steel and aluminum. A particularly preferred material is a filled nylon or other filled polymer material as it is self lubricating, corrosion-resistant, and most importantly, self-locking. The preferred filled nylon material also may be used for the mounting plates or yoke 28 into which the nut and studs fit. The optimum material for the nut due to its strength, dimensional stability and self-locking properties is nylon 66 filled with particles of $MoS_2$. The additive adds lubricity to the threaded parts while also lowering wear. The filled nylon is commercially available.

The threaded studs in some instances may be substituted with gauged bars of predetermined length. This system is particularly satisfactory where there are a variety of fixed cuts which need to be performed. A person of low skill level could exchange one group of spacer bars for another without necessity for measuring the results of setting changes and making suitable adjustments.

It is noted that if there are more cutters on the slitter than necessary to make the desired cuts, it is possible that the spacer bars or stud assemblies for the unused cutters may continue to be used, and the head of any cutter merely pneumatically withdrawn from cutting position. It is also noted that large changes in slit width may be accomplished rapidly by exchanging adjusting stud assemblies FIG. 4 with other assemblies preadjusted to the new slit width with only minor adjustments required to fine tune the slit widths.

The structure on which the cutters ride during adjustments may be any suitable structure and does not necessarily require the spaced parallel rods 72 and 74 as illustrated. Any other movable system that allows sliding adjustments so that the cutter blades may be moved but are rigidly held without play of the bearings would be suitable. The system of adjustable ball bearing bushings for longitudinal travel on rails has been found to be particularly suitable in view of their adjustability and low play.

Figure 5:
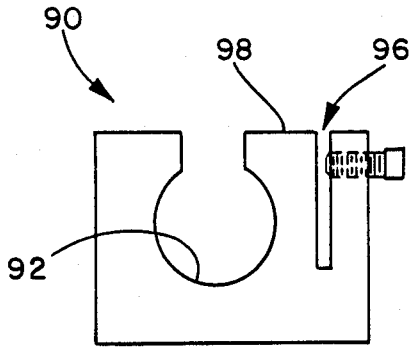
FIGS. 5 and 6 are views of a locking device to hold the cutters to the rails on which they slide.
Figure 6:
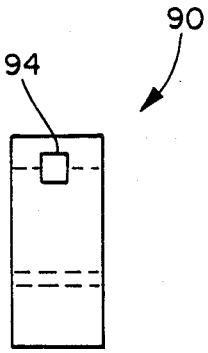

In the use of the system of the instant invention one of the cutters generally is locked to prevent its movement on the rails 72 and 74. This may be performed by placing movable locking blocks 90 such as illustrated in FIG. 5 and FIG. 6 onto the rail on each side of one or more cutters. Alternately the set of cutters after adjustment may be locked by a locking block on each end of the row of cutters. The block 90 has opening 92 to receive the rail 72 or 74. The block is tightened onto the rail by screw 94 that pushes portion 98 against the rail to lock the stop in place. A lock may be placed on each side of one cutter and then the other cutters are adjusted closer or further from the fixed cutter. As illustrated in FIG. 1, the locking blocks 90 are locking cutter 69. The locking block on the far side of the cutter 69 is not visible in the view shown but the block 90 on each side of the cutter 69 serves to fix the cutter and allow adjustment of the other cutters in relation to the fixed cutter 69.

While illustrated as a manual adjustment system, it is within the invention to utilize several motors to drive the stud adjusting mechanisms. The motors would be driven in response to sensors that detect the width of the ribbons being cut and adjust the cutter spacing to correct any deviations. It is also possible that the several motors could respond to preprogramed settings to position the slitter with the cutters in any arrangement.

The control apparatus of the invention may be utilized in any slitter system including those employing other types of cutters such as driven cutters. Further, it may be utilized for cutting material such as paper, plastic, films or cloth. A particularly preferred use has been found in the cutting of coform material. Coform is an air-formed blend of divelicated wood fibers and microfilaments of meltblown polypropylene. In the cutting of this material the apparatus as partly illustrated in FIG. 1 is utilized with the coform material 15 passing beneath a tensioning roller 17 and then going upward beneath the cutters that rest against the backing roll 18.

It will be understood that modifications and variations of the invention may be effected without departing from the scope of the novel concept of this invention. For instance, while described for positioning of cutters in slitting apparatus, the system also would be useful for spacing of devices such as ultrasonic or heated welders that are joining two sheets of material together along predetermined lines. The treatment devices also could be marking devices for printing or painting. Another series of treatment devices might be perforators. The invention is intended to be limited by thre scope of the claims attached hereto.

We claim:

1. Apparatus for adjusting a series of treatment devices comprising individual linking means extending between each adjacent pair of said treatment devices and means for adjusting each of said linking means to change the length of said linking means, wherein each of said treatment devices is provided with a bracket for removably mounting said linking means.

2. The apparatus of claim 1 wherein each said bracket is adapted to hold two of said individual linking means.

3. The apparatus of claim 2 wherein the said individual linking means comprise a stud and two nuts and each of said nuts is adapted to be rigidly held by said bracket.

4. The apparatus of claim 1 wherein the said treatment devices are mounted with sliding bearings on at least 2 parallel rails.

5. The apparatus of claim 1 wherein said treatment devices are cutters.

6. The apparatus of claim 3 wherein said nuts are formed of polymer material that is self-locking to hold said studs in a set position.

7. The apparatus of claim 6 wherein said material is a filled nylon.

8. The apparatus of claim 4 wherein said bearings contain ball bearings arranged in the direction of sliding movement of said bearing.

9. The apparatus of claim 1 wherein said means for adjusting said linking means comprises the replacement of one length of linking means with another of a different length.

10. The apparatus of claim 3 wherein said means for adjusting is the turning of said stud.

11. The apparatus of claim 1 further comprising means to lock at least one of said treatment devices in a fixed position.

12. The apparatus of claim 6 wherein said self-locking material comprises $MoS_2$ filled nylon 66.

* * * * *